US005803112A

United States Patent [19]

Andersson

[11] Patent Number: 5,803,112

[45] Date of Patent: Sep. 8, 1998

[54] REFLUX VALVE MEANS

[75] Inventor: Lars Andersson, Täby, Sweden

[73] Assignee: AB Durgo, Solna, Sweden

[21] Appl. No.: 667,851

[22] Filed: Jun. 20, 1996

[30] Foreign Application Priority Data

Jun. 22, 1995 [SE] Sweden ..... 9502279

[51] Int. Cl.[6] ..... F16K 24/00

[52] U.S. Cl. ..... 137/217; 137/526; 137/533.21; 137/533.29

[58] Field of Search ..... 137/217, 526, 137/533.21, 533.29; 251/334

[56] References Cited

U.S. PATENT DOCUMENTS

| | | | |
|---|---|---|---|
| 2,102,848 | 12/1937 | Kocour | 137/217 |
| 3,025,870 | 3/1962 | Mackey | 137/217 |
| 3,605,132 | 9/1971 | Lineback | 137/526 X |
| 4,643,221 | 2/1987 | Parker | 137/526 X |
| 4,827,538 | 5/1989 | Heimann et al. | 137/526 X |

*Primary Examiner*—Gerald A. Michalsky
*Attorney, Agent, or Firm*—Jacobson, Price, Holman & Stern, PLLC

[57] ABSTRACT

A reflux valve means for a fluid conduit (30) having a fluid outflow end, wherein the valve means includes a vacuum valve (10) intended for connection to a conduit branch (18) preferably to a top part or rising gradient of the conduit upstream of its outlet end. The valve (10) includes a valve housing (15, 16) provided with a passageway (20, 17, 19) which establishes communication between the atmosphere surrounding the valve and the conduit branch (18). The passageway includes a valve seat (12) and a valve plate (11) which can be moved into and out of sealing contact with the seat (12) under the influence of conduit pressure that is higher than atmospheric pressure. The valve plate (11) of the vacuum valve is constructed to be deformable elastically into and out of a generally dish shape when the valve is closed, under the influence of those pressure variations that normally occur in the fluid in the conduit branch.

6 Claims, 2 Drawing Sheets

REFLUX VALVE MEANS

FIELD OF THE INVENTION

The present invention relates to a reflux valve means for a fluid conduit that has a fluid outlet end, wherein the valve means includes a vacuum valve for connection to a conduit branch, preferably to a top part or rising gradient of the conduit upstream of its outlet end, wherein the valve includes a valve housing having a passageway which establishes communication between the surrounding valve atmosphere and the conduit interior, said passageway having a valve seating, and wherein the valve further includes a valve plate which can be moved into and out of sealing contact with the valve seating in response to a pressure difference across the valve plate.

DESCRIPTION OF THE RELATED ART

An automatically acting reflux valve is often used in fluid conduits to prevent back-suction, or reflux, of contaminated liquid or gas through the outlet end of the conduit. An example in this regard is a drinking water conduit in which the water is either pressurized or subjected to pressure therein with the aid of a pump and driven through the conduit towards and out through an outlet end thereof, there being a risk of the water becoming contaminated externally of said outlet end. If the pressure of the water in the conduit drops, for instance due to a burst conduit or to a malfunctioning water pump, or due to some other cause, there is a danger of contaminated fluid being sucked back through the outlet end of the conduit and contaminating the interior thereof and components connected thereto, and also the fluid or water carried by the conduit. The aforesaid valve functions to prevent the reflux of contaminated fluid back into the conduit.

In many parts of the world, the valve used to this end is a check valve or non-return valve which is connected in series to the end of the conduit.

The use of a check valve in this regard is encumbered with certain drawbacks. For instance, the check valve is closed each time fluid ceases to flow in the conduit. This repeated closure of the check valve may well result in sealing defects and also in malfunctioning of the valve plate or valve closing springs, due to fatigue. The check valve also constitutes a resistance to the flow of fluid through the system.

In practice two check valves have been connected in series, and an overflow hole is provided in the wall of the conduit in the region between the two check valves in order to permit checking of correct operation of the check valves. This solution is both complex and expensive.

As an alternative to check valves, other parts of the world have instead used a so-called vacuum valve which is connected laterally to the conduit close to its outlet end, preferably at a high gradient point so as to break any possible siphoning effect. The advantage of such a valve is that it seldom needs to come into operation when the pressure drop in the conduit or the fluid pressure in said conduit becomes lower than the surrounding ambient or atmospheric pressure. With regard to the use of such a vacuum valve, suspicions have been expressed in some quarters that the valve plate tends to stick to the valve seating in the passage of time, therewith delaying or preventing activation of the valve and resulting in greater or lesser degrees of conduit contamination.

In recent times, vacuum valves intended for the aforesaid purpose have been provided with a valve plate which is coated with Teflon® or some corresponding material in its active region with the valve seat, wherein the seat sealing surface is formed by an O-ring which is partially sunken into an O-ring groove in the relatively hard seat material. Such vacuum valves have been found to function effectively even after relatively long operating times.

SUMMARY OF THE INVENTION

The object of the present invention is to further improve a vacuum valve of the aforesaid kind for the aforesaid field of use, by virtue of further reducing the tendency of the valve plate to stick to the valve seat after long valve operating times with the valve closed. In this regard, the object of the invention is to provide a vacuum valve construction having properties which will persuade users collectively to use such vacuum valves instead of the earlier used check valves as a means of protection against reflux.

An important feature of the invention is that the valve plate of the vacuum valve is designed so that it will deform elastically in the valve closing direction under the influence of those pressure variations that normally occur in conduit-conducted fluids. In this way, the rim of the valve plate will move substantially in relation to the seat sealing member, when seen in axial section through the valve plate, and the annular sealing line on the valve plate will also be moved radially.

According to one particularly preferred embodiment of the invention, the valve plate is made from a plastic material that has high mechanical strength in relation to its density, such as to obtain a lightweight valve plate. The valve plate, which is normally positioned to move to its valve closed position under the influence of gravity, thereby enables the valve to open at conduit subpressures as low as 5–6 mm water column relative to the surrounding atmosphere, and at an effective valve plate area on the atmosphere side as small as 5 $cm^2$.

The aforesaid elastic deformation/buckling of the valve plate can be established in a controlled manner, by providing the pressure side of the plate with radially extending grooves, so that the valve plate will more readily form a resilient valve body.

The prevention of malfunctions in valves, for instance as a result of the seat sealing element, normally in the form of an O-ring, sticking to the valve plate and being torn loose from the valve seat as the vacuum valve opens can be further improved by fastening the O-ring to the valve seat in the manner more specifically described below.

Subsequent to having affixed an O-ring in the valve seat, the O-ring can be ground down with a grinding tool having a guide stem which is received in the means provided for guiding the valve plate stem, this guide often becoming crooked when moulding the valve housing. This feature of the invention therefore provides a more positive seal against the annular part of the valve plate that coacts with the guide, said annular part being advantageously made of or coated with a release material, such as POM (polyoxymethylene) for instance, or Teflon®. The upsetting or swaging operation for shape-bound enclosure of the O-ring in the O-ring groove is preferably carried out so that buckling of the valve plate will not result in direct contact of the valve plate with the seat material surrounding the O-ring.

The invention will now be described in more detail with reference to an exemplifying embodiment thereof and also with reference to the accompanying drawings.

DESCRIPTION OF THE PREFERRED EMBODIMENT

Figure 1:
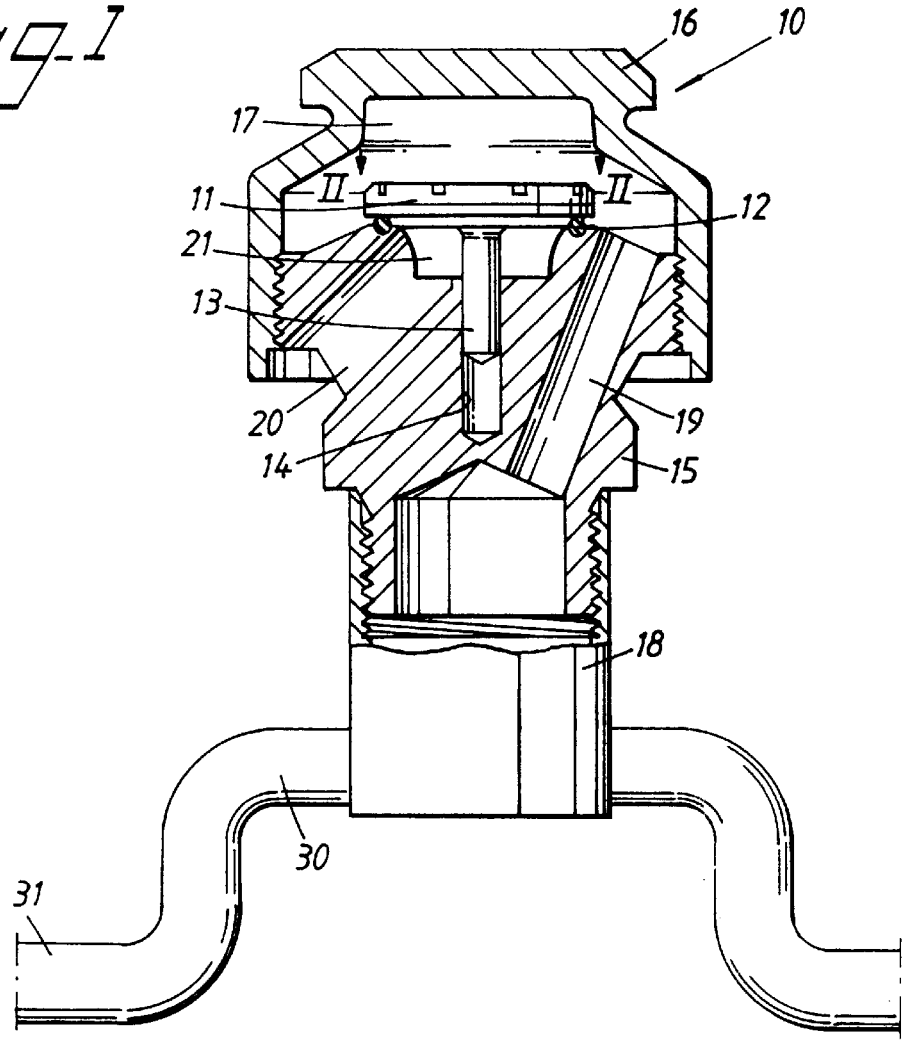
FIG. 1 is a schematic, axial section view of a vacuum valve for the aforesaid use.

FIG. 1 is an axial section view of an inventive vacuum valve 10 fitted to a conduit 30 for conducting fluid which has a pressure that substantially exceeds the pressure of the valve surroundings, or ambient pressure. The conduit 30 has an outlet end 31. The valve 10 is preferably mounted in a position which is higher than the position of the outlet end 31, said valve 10 preferably being located in a locally highest point or rising gradient of the conduit 30, preferably in the vicinity of its outlet end 31. The valve 10 includes a valve plate 11 which rests gravitationally against an annular member 12 forming a seat for the plate 11. The plate 11 is disposed generally horizontally and has a vertical stem 13 which is guided in a guide bushing 14 in the valve body 15. A casing 16 is connected to the valve body 15 such as to form a valve chamber 17. The valve body 15 also includes a stub connector 18 for connection to a branch of the conduit 30, said connector 18 being connected with the interior of the chamber 17 by a bore 19. An air passageway extends from the outside of the valve body 15 to a space 21 delimited by the seat 12 and the valve plate 11.

According to a central feature of the invention, the valve plate 11 is designed to be deformed elastically in response to pressure differences acting across the valve plate 11. The valve 10 is often used in drinking water systems, or tap water systems, in dwellings and like buildings, for instance to prevent the reflux of contaminated fluid into the conduit 30 through the outlet 31 when the water pressure falls away in the conduit 30.

By virtue of the inventive valve 10 being advantageously located in a local bottom part of the conduit 31, the valve 10 is able to quickly stop any siphoning effect through the conduit 30. The inventive valve 10 includes no spring means and relies solely on gravity to move the valve plate to a valve closed position in the absence of fluid pressure in the conduit 30. The valve plate 11 can be made light in weight and given a small mass by producing said plate (and its stem) from an acetal resin (polyoxymethylene, POM), thereby enabling the valve plate to be moved quickly to a valve open position in the event of subpressure in the connector 20, wherein the valve is able to open at low pressure differences, e.g. differences in the order of 5 mm water column subpressure in the conduit 30 relative to the surrounding atmosphere.

Figure 5:
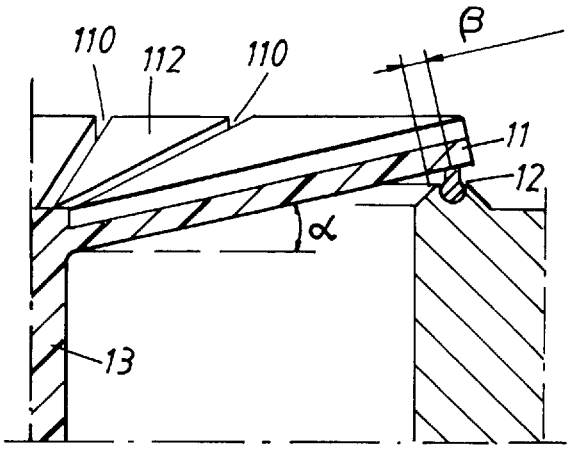
FIG. 5 illustrates elastic deformation of the valve plate when the valve is in operation.

By designing the valve plate 11 so that it will be deformed elastically to or from a generally cupped-shape or conical shape when subjected to load by the fluid pressure in the conduit 30, the important advantage is afforded whereby the rim of the valve plate 11 coacting with the seat sealing element 12 will be flipped or rocked in the axial plane of the plate 11 wherewith the plate will also slide radially in relation to the sealing element 12. FIG. 5 shows a flip angle $\alpha$ through which the valve plate 11 has moved around the sealing element 12 from a non-loaded state to a typical loaded state (the state shown) and a sliding path $\beta$ in which the valve plate slides relative to the sealing member 12 as the valve plate is deformed. The upper surface of the valve plate 11 is designated 112 in FIG. 5.

According to one embodiment of the invention, the sealing ring 12 has a diameter of 28 mm and the stem 14 a diameter of 6 mm, and the valve plate 11 and stem 13 are preferably made of POM and the valve plate 11 has a thickness of 5 mm. In the case of this embodiment, the upper surface of the valve plate 11 may have cut therein three angularly and equidistantly spaced diametrical grooves 110 having a width of 1.5 mm and a depth of 4 mm, such as to obtain the configuration shown in FIG. 2. The angle $\alpha$ may be about 6° at a tight water pressure of 4 kg/cm$^2$ in the conduit 30 (and atmospheric pressure on the underside of the valve plate 11). Normally, the variations in pressure in the conduit 30 (conduit pressure) will often be ±2 kg/cm$^2$, resulting in an angle variation of ±3° from $\alpha$=6°.

It will therefore be realized that in a typical case, the radius of the valve plate 11 will swing ±3° around the elastomeric ring at a relatively high frequency. This oscillation of the valve plate radius reduces the risk of the valve plate 11 sticking to the seat sealing element 12. Sticking tendencies are also inhibited by the fact that the annular area of contact of the valve plate with the sealing element 12 experiences radial movement in relation to said sealing element during this oscillatory or swinging movement, this radial displacement of said contact area reaching to about ± the radius of the sealing ring 12 multiplied by the change in angle $\alpha$. Thus, in the numerical example the maximum radial displacement is about 14×9° mm.

Figure 2:
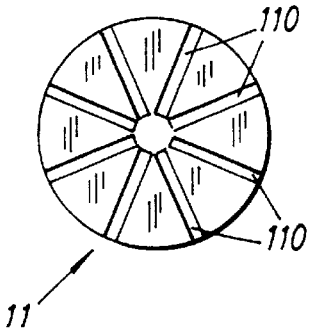
FIG. 2 is a schematic section view taken on the lines II—II in FIG. 1.
Figure 3:
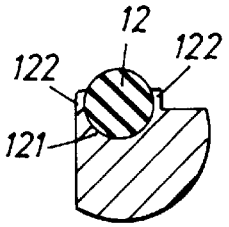
FIG. 3 is a schematic axial section view of a valve seat groove for receiving an O-ring.
Figure 4:
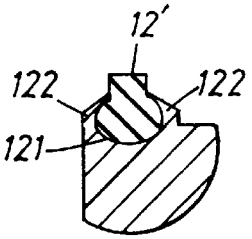
FIG. 4 is a schematic axial section view of FIG. 3 subsequent to having upset the edge of the groove and grinding-off the O-ring shape-bound in the groove.

In the FIG. 2 embodiment, the triangular part-elements of the valve plate 11 defined by the grooves 110 can be dimensioned to be flexed outwards by the influence of the pressure load, into contact with and along the sealing element 12 as the valve plate 11 begins to take its generally cupped shape.

Figure 6:
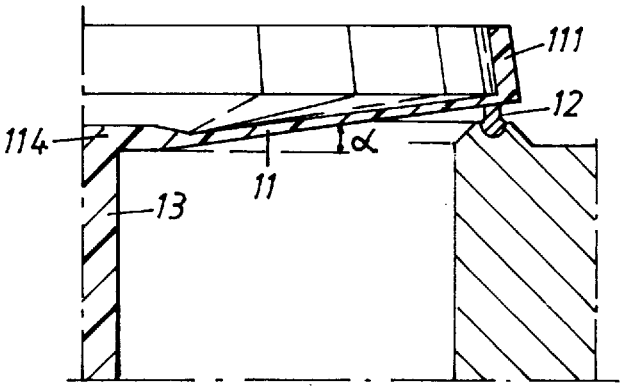
FIG. 6 is a schematic axial section view of an alternative embodiment of the invention.

Although the embodiment according to FIGS. 1 and 2 is the embodiment at present preferred, the valve plate 11 may be conceivably designed so as to remain rotationally-symmetrical even when deformed, so as to avoid any tendency towards leakage between the valve plate 11 and the sealing ring 12 as the valve plate begins to take a pyramidal cupped-shape or basin-shape under the influence of conduit pressure. In this regard, FIG. 6 illustrates an embodiment in which the rim of the valve plate is provided with a cylindrical flange 111 which is intended to be positioned roughly in alignment with the sealing element 12, and the valve plate 11 has a centrally positioned, relatively rigid hub part 114 which is connected to the stem 13, while the valve plate has a relatively thin wall between the hub 114 and the flange 111, thereby enabling the annular part 115 to be deformed more readily and cause rocking or flipping of the valve plate contact surface around the sealing element 12.

The seat sealing element 12 may conveniently have the form of an O-ring comprised of a high-quality elastomer, such as Viton®. According to one preferred embodiment of the invention, the valve body 15 is provided around the valve seat with an O-ring receiving groove 121 of a generally semi-circular profile, wherewith two mutually parallel cylindrical flanges 122 are established around the semi-circular groove section for receiving the O-ring 12. These flanges 122 are upset, or swaged, towards each other so as to clamp the bottom half of the O-ring firmly in the groove 121. The upstanding part of the O-ring 12 can then be ground away with the aid of a grinding tool which includes a flat grinding disk having a guide shank which extends in the normal direction and which is received in a bushing 13 in the valve body. By grinding off the O-ring, the resultant contact surface 12' will afford flat abutment of the valve plate 11 with the ring, despite any misalignment of the guide bushing 13.

Figure 7:
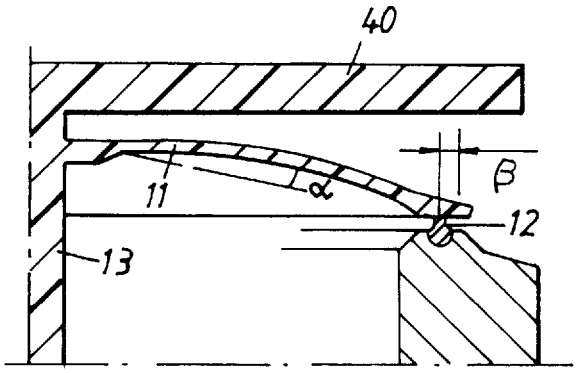
FIG. 7 is a schematic axial section view of a further embodiment of the present invention.

FIG. 7 illustrates an embodiment in which the valve plate 11 is comprised of an elastically deformable, cupped-shaped rotational-symmetrical disk whose rim coacts with the seal. The valve plate 11 is dimensioned for elastic deformation to a flat state under the influence of pressure variations in the fluid. In this regard, the wall of the valve plate is deflected through the angle $\alpha$, so as to cause the seal to be displaced radially through the distance $\beta$ in the region of the plate rim, while at the same time causing the rim region of the valve plate to flip or rock around the seal 12, as seen in the axial plane of the valve plate.

The FIG. 7 embodiment also includes a pressure plate 40 which when elastic deformation of the valve plate 11 is very pronounced functions to clamp the valve plate firmly against the seating 12 and therewith limit the maximum angle $\alpha$ and also to prevent the valve plate 11 being drawn through the seat 12 in the event of powerful fluid pressure surges.

I claim:

1. A reflux valve means for installation in a fluid conduit that has a fluid outflow end, wherein said valve means includes a vacuum valve intended for connection to a conduit branch substantially near a top part of the conduit upstream of its outlet end, said valve including a valve housing having a passageway which establishes communication between atmosphere surrounding the valve and the conduit branch, said passageway having a valve seat and a valve plate which can be moved into and out of sealing contact with said seat under the influence of a pressure which is higher and lower, respectively, in said conduit than atmospheric pressure, said valve plate of said vacuum valve being constructed for elastic deformation forward and away from a generally cupped shape in the closed state of the valve under the influence of pressure variations that normally occur in a fluid conducted in said conduit branch, said valve plate being provided on a surface thereof that lies proximal to the branch conduit with radial grooves which define flexing or bending regions for facilitating deformation of said valve plate into and out of said cupped-shape.

2. A valve means according to claim 1, wherein said valve plate is dimensioned for rocking movement around the area defined by a seat ring, as viewed in a plane diametrical to the valve plate, under the influence of the pressure variations normal for said fluid.

3. A valve means according to claim 2, wherein said valve plate rocks through an angle of at least ±1° from a normal position, with a fluctuation in pressure in said conduit of ±2 $kg/cm^2$.

4. The valve means as described in claim 3, wherein said valve plate rocks through an angle substantially near ±3° from a normal position.

5. A valve according to claim 1, wherein said valve plate has a stem which extends generally perpendicular to said valve plate and said valve housing has a guide which receives said stem for linear movement and said valve seat is defined by a shape-bound O-ring with a contact surface to said valve plate that had been ground down.

6. A valve means according to claim 5, wherein said valve plate is adapted to slide radially on said valve seat as said valve plate deforms elastically.

* * * * *